United States Patent [19]

Schuchardt et al.

[11] Patent Number: 4,552,727

[45] Date of Patent: Nov. 12, 1985

[54] COOLING DEVICE

[75] Inventors: Kurt Schuchardt, Brühl; Harald Scholz, Erftstadt; Hans W. Neuss, Brühl; Georg Pech, Erftstadt, all of Fed. Rep. of Germany

[73] Assignee: Hoechst Aktiengesellschaft, Fed. Rep. of Germany

[21] Appl. No.: 586,057

[22] Filed: Mar. 5, 1984

[30] Foreign Application Priority Data

Mar. 17, 1983 [DE] Fed. Rep. of Germany ..... 3309576

[51] Int. Cl.[4] ..... B01J 19/02; F27D 1/00; F28F 21/04; F28F 21/06

[52] U.S. Cl. ..... 422/241; 422/207

[58] Field of Search ..... 422/241, 240, 207; 55/435; 261/117, 118, DIG. 54

[56] References Cited

U.S. PATENT DOCUMENTS 3,593,968 7/1971 Geddes ..... 261/118

4,087,497 5/1978 Opitz et al. ..... 55/435

*Primary Examiner*—Barry S. Richman

*Assistant Examiner*—Carol M. Delahunty

*Attorney, Agent, or Firm*—Connolly and Hutz

[57] ABSTRACT

A cooling device for quenching hot, highly corrosive combustible gases containing chlorine and hydrogen chloride comprises an elongated steel vessel having rounded top and bottom end portions, an inlet connection on the top end portion, a plurality of inclined connections in the top end portion to facilitate injection of quenching liquid, a lateral outlet connection in the lower third of the steel vessel for quenched combustion gases and quenching liquid, an axial outlet connection on the bottom end portion of the steel vessel for cleaning purposes and also providing an outlet for the quenching liquid, an acid-resistant hard rubber lining extending over the interior surfaces of the steel vessel and all connections, an acid-resistant ceramic lining on the hard rubber lining, and a refractory lining in the upper portion of the steel vessel on the acid-resistant lining. The innermost surface of the cooling device comprises a lining of further acid-resistant material which forms an interior cylindrical wall of equal diameter throughout.

10 Claims, 1 Drawing Figure

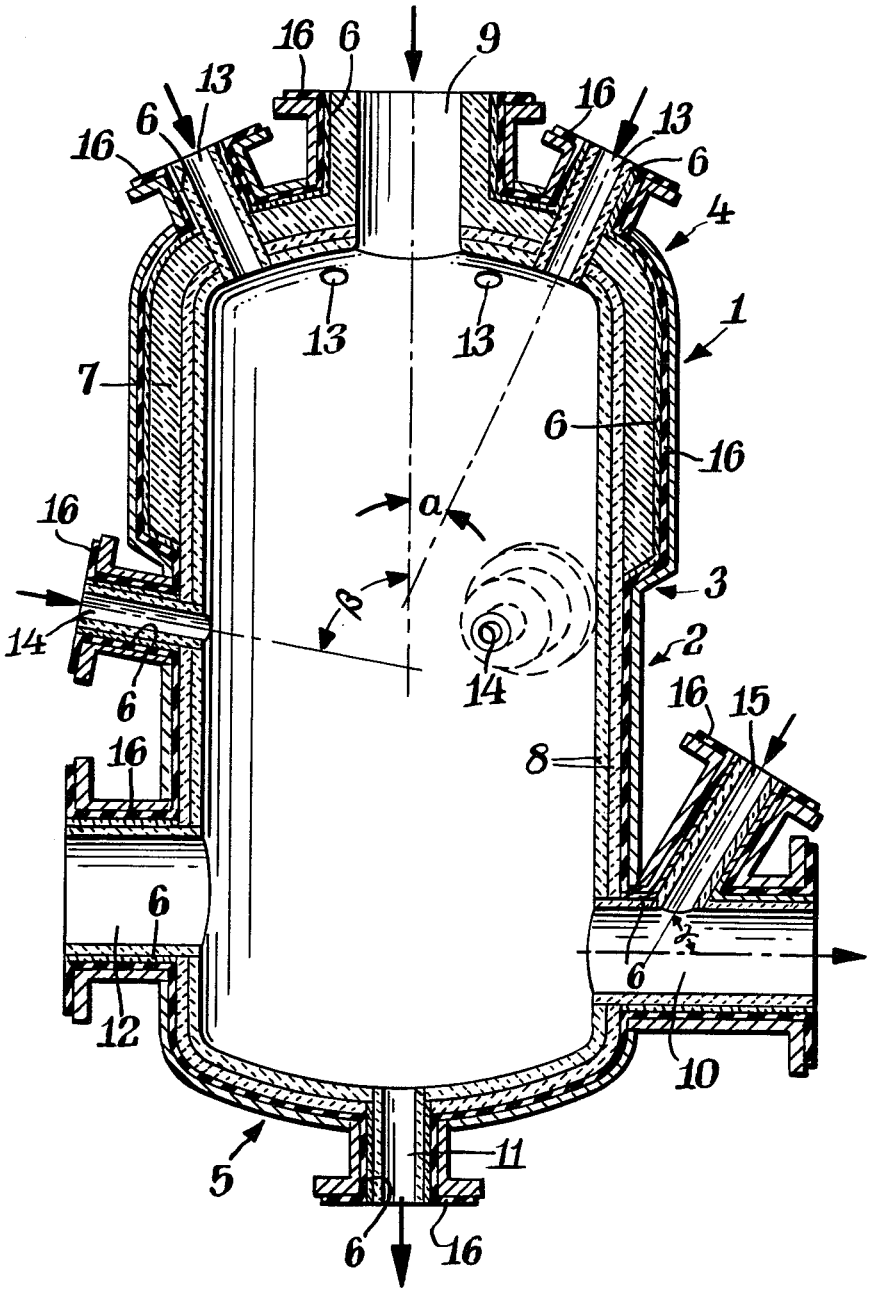
16
6
9
13
16
6
16
13
6
4
13
13
1
7
6
16
16
a
3
β
14
2
14
6
16
15
16
8
6
6
12
10
5
11
6
16

COOLING DEVICE

This invention relates to a cooling device ("a quench"), wherein hot corrosive combustion gases, such as those originating from the combustion of gaseous and/or liquid chlorine-containing residues, or chlorinated hydrocarbons are cooled by the injection of a quenching liquid.

A quench of this kind is technically difficult to design and construct inasmuch as it is necessary, on the one hand, for the hot corrosive gases to be reliably cooled and, on the other hand, for the most various thermal and corrosive stresses the various zones of the quench are subjected to to be controlled.

More especially, the upper portion of the quench is thermally stressed by hot combustion gases introduced thereinto at temperatures of up to 1400° C. Needless to say therefore, it is necessary for the steel jacket of the quench to be lined and protected against overheating phenomena (hot zone).

Quenching the waste gases to less than 100° C. by means of water or aqueous hydrochloric acid with partial absorption of corrosive waste gas constituents in the quenching liquid makes it necessary for the steel jacket to be protected chiefly against corrosion (wet zone).

It is well known in the art that a steel vessel can be protected against overheating, e.g. by lining it with heat-insulating ceramic bricks, and against corrosion, e.g. by lining it with rubber and ceramic plates.

In practice, the problem encountered with a quench of the kind described resides in the fact that the boundary line between hot zone and wet zone is not sharply drawn. Within the region where hot combustion gases and injected quenching liquid come into impinging contact with one another, there is great turbulence whereby liquid is inter alia carried upwardly deeply into the hot zone; on the other hand, the wet zone wall, especially within the region of the injection nozzles, is not everywhere sufficiently wetted and cooled and thus becomes locally overheated. In other words, a quench comprises a rather extended transition zone in which it is invariably necessary for the steel jacket to be protected against overheating and at the same time against corrosion.

In addition to this, there is no lining material which would simultaneously provide satisfactory protection against corrosion and heat. Heat-insulating bricks are not corrosionproof whilst anticorrosive hard rubber or ceramic plate linings lack heat-resistance; in other words, the plates remain indeed unaffected but they are unable to keep heat away from the hard rubber lining.

All those quenches in use which have the upper portion of their steel jacket protected merely against overheating and their lower portion merely against corrosion, and in which a heat-insulating ceramic lining is directly applied to the anticorrosive lining, fail to comply with the requirements made in practice.

German Patent Specification DE-PS No. 26 21 718 C3 (U.S. Pat. No. 4,087,497) describes a quench of which the steel jacket is completely lined with anticorrosive material, the heat-sensitive lining in the upper hot zone being protected by means of a layer of heat-insulating bricks which is applied thereto. An intermediate or middle zone which would simultaneously provide protection against heat and corrosion does not exist. In other words, the heat insulating bricks lack protection against corrosion and the anticorrosive lining provided in the lower wet zone lacks protection against heat in its upper region.

The adverse effects associated with such prior quench can be summarized as follows:

1. The heat-insulating bricks applied to the upper hot zone lack protection against corrosion; whenever they become damaged due to overheating, the rubber lining and ultimately the steel jacket are destroyed as the layer of ceramic plates applied to the rubber lining alones does not ensure sufficient protection against corrosion.

2. The layer of heat-insulating material terminates abruptly at the level of the spray nozzles without the position and extension of the spray or transition zone, which is open to the attack of heat and corrosion, being exactly known.

3. The anticorrosive lining in the lower wet zone lacks protection in its upper region against overheating.

4. The injection of quenching liquid at just one level at an angle of 60° relative to the direction of gas flow reduces the efficiency of the quench and favors the occurrence of local overheating phenomena since the spray cones which would be produced by the selection of a customary 90° spray angle for the injection nozzles would, in this case, not fully extend across the quench's entire cross-sectional area, but leave wall segments, so-called hot windows, below the respective nozzle, unwetted.

The present invention now provides a quench resistant to thermal and corrosive stresses, operable under heavy load. The essential features of the quench of this invention provide:

1. for the entire steel jacket to be protected against corrosion by lining it with rubber and ceramic plates, as described in DE-PS No. 26 21 718 C3 (U.S. Pat. No. 4,087,497);

2. for the heat-sensitive acid-resistant lining in the upper steel jacket portion to be protected by means of heat-insulating bricks which are applied thereon as described, e.g. in DE-PS No. 26 21 718 C3 (U.S. Pat. No. 4,087,497);

3. for the heat-insulating layer to reach deeply into the wet zone to provide for an extended transition zone protecting the steel jacket against heat and corrosion;

4. for the heat-insulating bricks to be protected against corrosion by means of acid-resistant ceramic plates which are applied thereon;

5. for the quenching liquid to be injected at two levels, using at least six nozzles at the upper level and at least three nozzles at the lower level; this permits the quench to be operated under high specific space load (kilojoules/$m^3$) and the formation of hot windows in the wet zone to be avoided;

6. for the first level die bases to be installed above the curvature of the rounded top end portion so that the axes of the gas-admitting connection and die bases include an angle of about 30°. This results in less turbulence and in the formation of stable spray cones permitting the wall of the quench to be reliably wetted and cooled, variations during operation leaving the wetting and cooling effect fairly unaffected. The occurrence of hot windows is also avoided in the manner described;

7. for the quench to be conveniently given the dimensions necessary to ensure, for the combustion waste gases, a linear flow velocity of 0.5 to 1.5 m/sec, preferably 1.0 m/sec (at atmospheric pressure and 100° C.) and a residence time of 2–8 seconds, preferably 3–4 seconds. The linear flow velocity is determined by the diameter of the quench, whilst the residence time is determined by the height of the quench, a height-to-diameter ratio of 1.5:1 to 3:1 being preferred;

8. for the upper portion of the quench to have a diameter enlarged compared with that of the lower portion, to the extent necessary to provide the space receiving the additional heat-insulation lining, the space fully lined forming with the lower portion a cylindrical interior.

The cooling device of this invention and its functioning will now be described with reference to the accompanying drawing which is not accurately a true to scale representation:

The steel jacket of the quench is comprised of two steel cylinders (1, 2) different in diameter, welded together at conically tapered transition area (3), and closed by means of rounded top end and bottom end portions (4, 5) respectively.

The upper cylindrical steel jacket portion (1) has a diameter enlarged, compared with that of the lower portion, to the extent necessary to provide the space for receiving, in the upper hot zone, the additonal brick linings (6, 7).

An axial connection (9) admitting combustion gases to the quench, opens centrally into the steel vessel from above. Arranged in the lower third, close to the rounded bottom end portion, is a lateral gas outlet (10) which also serves as a quenching liquid outlet. The lowermost axial drain connection 11 opening centrally into the quench is used for emptying and cleaning purposes, at standstill. It can also be used for separately removing quenching liquid during operation. Secured laterally to the lower cylindrical portion (2) of the steel jacket is a connection (12) facilitating assembly and repair work. At least six connections (13) receiving the die bases are arranged at regular intervals around gas-admitting connection (9) so that the axes of the die bases and axis of the gas-admitting connection (9) include an angle of about 30° (angle $\alpha$ in drawing). At least three slightly downwardly directed connections (14) receiving the second level die bases are disposed within the upper region of the wet zone (cylindrical portion 2).

Mounted on gas outlet (10) is an auxiliary connection (15) receiving a quenching nozzle as an additional safety means for connected plastics devices and conduits.

To provide protection against corrosion, the entire inner surface area of the steel vessel, including all connections and sockets up to and beyond the sealing surfaces of flanges, has an acid-resistant rubber lining (16) applied to it. The rubber-lined enlarged upper portion (1, 4) has an acid-resistant ceramic brick or plate lining (6) applied to its rubber lining (16) and a heat-insulating ceramic brick or plate lining (7) applied to its acid-resistant ceramic brick or plate lining (6). Connections (10 to 15) are lined with acid-resistant plates and gas-admitting connection (9) is lined with acid-resistant and heat-insulating plates.

The interior so prepared comprises a cylinder everywhere equal in diameter and rounded top and bottom end portions. A one or two layer corrosion resistant ceramic lining (8) is provided on the interior of the cooling device.

The temperature of the rubber lining and temperature of the gases admitted are monitored as usual by means of temperature sensors.

The present invention relates more particularly to a cooling device suitable for use in the quenching of hot, highly corrosive combustion gases containing chlorine and hydrogen chloride, the cooling device being formed of; an elongated circular steel vessel having rounded end portions, these being, in reference to the orientation of the vessel when it is in use, top and bottom end portions; an axial gas-admitting connection provided on the top end portion of the steel vessel; a plurality of connections are inclined at an angle $\alpha$ with respect to the longitudinal axis of the vessel and disposed at regular intervals around a horizontal zone situated in the top third of the steel vessel which connections, in use, receive nozzles for the injection of a quenching liquid circulated around a closed circuit; a lateral connection in the lower third of the steel vessel, above the rounded bottom end portion, providing, in use, an outlet for quenched combustion gases and the quenching liquid; an axial connection provided on the bottom end portion of the steel vessel for cleaning purposes and providing, in use, an outlet for the quenching liquid; an acid-resistant hard rubber lining extending over the inner surfaces of the steel vessel and all connections; an acid-resistant ceramic lining on the interior surface of the acid-resistant hard rubber lining; and a refractory lining of heat insulating bricks on the interior surface of the acid-resistant ceramic lining in the upper region of the steel vessel; and in which cooling device the upper steel vessel portion (1) comprises 40 to 50% of the vessel's total height and has a diameter larger than the diameter of the lower steel vessel portion (2); the upper portion (1) and rounded top end portion (4) are lined on the interior surfaces with heat-insulating bricks (7); the lower portion (2) is provided with a straight connection opening laterally thereinto, facilitating assembly and repair work; the heat-insulating bricks (7) having a protecting acid-resistant ceramic lining (8) applied to their surface facing the interior of the device; and the cooling device's interior surface comprises a cylinder of equal diameter, such interior being completely lined with acid-resistant ceramic material.

Further preferred and optional features of the cooling device of this invention provide:

(a) for at least six connections (13) to be disposed in the rounded top end portion (4) around the axial connection (9), the said connections (13) and the longitudinal axis of the vessel forming an angle $\alpha$ of 25° to 35°;

(b) for at least three downwardly directed inclined connections (14) to be disposed at regular intervals around a second horizontal zone situated above connection (12), the said connections (14) and longitudinal axis of the vessel forming an angle $\alpha$ of 70° to 80° and receiving, in use, a plurality of nozzles for the injection of quenching liquid circulated in a closed circuit;

(c) for a connection (15) receiving a nozzle for the injection of the quenching liquid to be mounted on connection (10) providing an outlet for the quenched combustion gases and the quenching liquid, the connection (15), being inclined against the direction of flow and forming an angle $\gamma$ of 50° to 70° with the horizontal axis of outlet connection (10);

(d) for the acid-resistant lining (8) facing the interior of the vessel to comprise a double layer of ceramic liner plates laid in acid-resistant mortar;

(e) for the acid-resistant lining (6) applied to the acid-resistant hard rubber lining (16) of all connections, in the region of upper vessel portion (1) and rounded top end portion (4) to consist of a single layer of ceramic liner plates or pieces laid in acid-resistant mortar;

(f) for the upper steel vessel portion (1) to have a diameter 10 to 20% larger than the diameter of the lower steel vessel portion (2);

(g) for the upper steel vessel portion (1) to form a conically tapered transition area into the lower steel vessel portion (2); and (h) for the vessel to have a height-to-diameter ratio of 1.5:1 to 3:1.

We claim:

1. A cooling device for quenching hot, highly corrosive combustion gases containing chlorine and hydrogen chloride comprising an elongated steel vessel having a longitudinal axis, upper and lower portions, and rounded top and bottom end portions, an axial inlet connection means on the top end portion of the steel vessel, a plurality of quench injection connection means inclined with respect to the longitudinal axis of the vessel and disposed at regular intervals around a horizontal zone situated in the top third of the steel vessel for use in injecting quenching liquid into the vessel, a lateral outlet connection means in the lower third of the steel vessel above the rounded bottom end portion providing an outlet for quenched combustion gases and quenching liquid, an axial quench outlet connection means on the bottom end portion of the steel vessel for use in cleaning purposes and as an outlet for quenching liquid, an acid-resistant hard rubber lining extending over the interior surfaces of the steel vessel and all connection means, a first acid-resistant ceramic lining extending over the interior surfaces of the acid-resistant hard rubber lining in the upper steel vessel portion and all connection means, a refractory lining of heat insulating bricks on the interior of the first acid-resistant ceramic lining in the upper portion of the steel vessel, the upper steel vessel portion comprising 40 to 50% of the total height of the vessel and having a diameter larger than the diameter of the lower steel vessel portion, and the heat-insulating bricks in the upper steel vessel portion and the acid-resistant hard rubber lining in the lower steel vessel portion having a second acid-resistant ceramic lining on the interior surfaces thereof, the interior surfaces of the heat-insulating bricks in the upper steel vessel portion and the acid-resistant hard rubber lining in the lower steel vessel portion forming a cylindrical surface of equal diameter throughout the elongated steel vessel.

2. A cooling device as in claim 1 wherein the plurality of inclined connection means in the top third of the steel vessel comprise at least six connections disposed in the rounded top end portion around the axial inlet connection means, each inclined at an angle of 25° to 35° with respect to the longitudinal axis of the vessel.

3. A cooling device as in claim 1 including at least three downwardly directed inclined connection means for introducing quenching liquid disposed at regular intervals around a second horizontal zone situated above the lateral outlet connection means, each downwardly directed inclined connection means forming an angle of 70° to 80° with respect to the longitudinal axis of the vessel.

4. A cooling device as in claim 1 including an inclined auxiliary connection means on the lateral outlet connection means for introducing quenching liquid, the auxiliary connection means being inclined against the direction of flow through the lateral outlet connection means and forming an angle of 50°–70° with respect to the axis of the lateral outlet connection means.

5. A cooling device as in claim 1 wherein the second acid-resistant ceramic lining forming the innermost surface of the device comprises a double layer of ceramic liner plates in acid-resistant mortar.

6. A cooling device as in claim 1 wherein the first acid-resistant ceramic lining comprises a single layer of ceramic liner plates or pieces in acid-resistant mortar.

7. A cooling device as in claim 1 wherein the vessel has a height-to-diameter ratio in the range of 1.5:1 to 3:1.

8. A cooling device as in claim 1 wherein the lower portion of the steel vessel includes a straight connection means laterally opening into the vessel to facilitate assembly and repair work.

9. A cooling device as in claim 1 wherein the upper steel vessel portion has a diameter 10 to 20% larger than the diameter of the lower steel vessel portion.

10. A cooling device as in claim 9 wherein the upper steel vessel portion is connected to the lower steel vessel portion by a conically tapered transition portion.

* * * * *

UNITED STATES PATENT OFFICE

CERTIFICATE OF CORRECTION

Patent No. 4,552,757 Dated November 12, 1985

Inventor(s) BRIAN R. MURPHY, ROBERT M. CHANACK, ROBERT G. WEBSTER, VIRGINIA S. HINSHAW It is certified that error appears in the above-identified patent and that said Letters Patent are hereby corrected as shown below:

IN THE ABSTRACT:

Line 2, "reassortment" should be --reassortant--.

Signed and Sealed this

*Twenty-second* Day of *July 1986*

[SEAL]

*Attest:*

DONALD J. QUIGG

*Attesting Officer* *Commissioner of Patents and Trademarks*